US010850535B2

(12) United States Patent
Yamasaki et al.

(10) Patent No.: US 10,850,535 B2
(45) Date of Patent: Dec. 1, 2020

(54) DRYING DEVICE AND IMAGE FORMING APPARATUS

(71) Applicant: FUJI XEROX CO., LTD., Tokyo (JP)

(72) Inventors: Shunsuke Yamasaki, Yokohama (JP); Yasunori Momomura, Yokohama (JP); Masayuki Yamagishi, Yokohama (JP); Yasuhisa Gonda, Yokohama (JP); Yoshitaka Kuroda, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/158,358

(22) Filed: Oct. 12, 2018

(65) Prior Publication Data

US 2019/0283457 A1 Sep. 19, 2019

(30) Foreign Application Priority Data

Mar. 13, 2018 (JP) ..... 2018-045830

(51) Int. Cl.
*B41J 29/377* (2006.01)
*B41J 11/00* (2006.01)

(52) U.S. Cl.
CPC ..... *B41J 11/002* (2013.01); *B41J 29/377* (2013.01)

(58) Field of Classification Search
CPC ..... B41J 11/002; B41J 29/377
See application file for complete search history.

(56) References Cited

U.S. PATENT DOCUMENTS

2006/0238592 A1* 10/2006 Kadomatsu ..... B41J 2/2114 347/102
2011/0115120 A1* 5/2011 Hattori ..... B29C 45/7306 264/237
2016/0152047 A1* 6/2016 Houjou ..... B41J 11/002 347/16
2018/0001665 A1 1/2018 Isozaki et al.

FOREIGN PATENT DOCUMENTS

JP 2015-147347 8/2015
JP 2018-001509 1/2018

OTHER PUBLICATIONS

English language abstract and machine translation of JP 2015-147347.

* cited by examiner

*Primary Examiner* — Scott A Richmond
(74) *Attorney, Agent, or Firm* — Fildes & Outland, P.C.

(57) ABSTRACT

A drying device includes a light irradiation part that irradiates a recording medium on a recording-medium movement route with light to evaporate moisture contained in droplets attached to the recording medium, and an air blowing part that is positioned on a downstream side from the light irradiation part in a recording-medium movement direction, and blows air onto the recording medium on the recording-medium movement route. The drying device changes the distance between a light irradiation position of the light irradiation part on the recording-medium movement route and an air-blowing target position of the air blowing part on the recording-medium movement route.

16 Claims, 7 Drawing Sheets

DRYING DEVICE AND IMAGE FORMING APPARATUS

CROSS-REFERENCE TO RELATED APPLICATIONS

This application is based on and claims priority under 35 USC 119 from Japanese Patent Application No. 2018-45830 filed Mar. 13, 2018.

BACKGROUND

Technical Field

The present disclosure relates to a drying device and an image forming apparatus.

Related Art

Patent Literature 1 discloses a configuration having a heat generation film on the lower surface of a glass plate (the surface facing a conveyance path for recording media) as a member for preventing the dew condensation from occurring on the glass plate.

[Patent Literature 1] Japanese Patent Application Laid-Open No. 2015-147347

On the occasion of irradiating a recording medium with light by a light irradiation part for evaporating moisture contained in droplets attached to the recording medium, if air is blown onto the recording medium on the downstream side of the light irradiation part, moisture vapor staying on the surface of the recording medium moves. Therefore, it is possible to accelerate evaporation of moisture contained in the droplets attached to the recording medium.

In this configuration, depending on the positional relation between the light irradiation position and the air-blowing target position, the amount of moisture which evaporates varies, and evaporation of moisture may accelerate; however, on the contrary, evaporation of moisture may become more difficult.

SUMMARY

Aspects of non-limiting embodiments of the present disclosure relate to perform blowing of air onto a recording medium having droplets attached thereon under a more appropriate condition for evaporating moisture, as compared to the case where it is impossible to change the distance between the light irradiation position of a light irradiation part and the air-blowing target position of an air blowing part.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a drying device including: a light irradiation part that irradiates a recording medium on a recording-medium movement route with light to evaporate moisture contained in droplets attached to the recording medium; and an air blowing part that is positioned on a downstream side from the light irradiation part in a recording-medium movement direction, and blows air onto the recording medium on the recording-medium movement route. The drying device changes the distance between a light irradiation position of the light irradiation part on the recording-medium movement route and an air-blowing target position of the air blowing part on the recording-medium movement route.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present invention will be described in detail with reference to the accompanying drawings.

Figure 1:
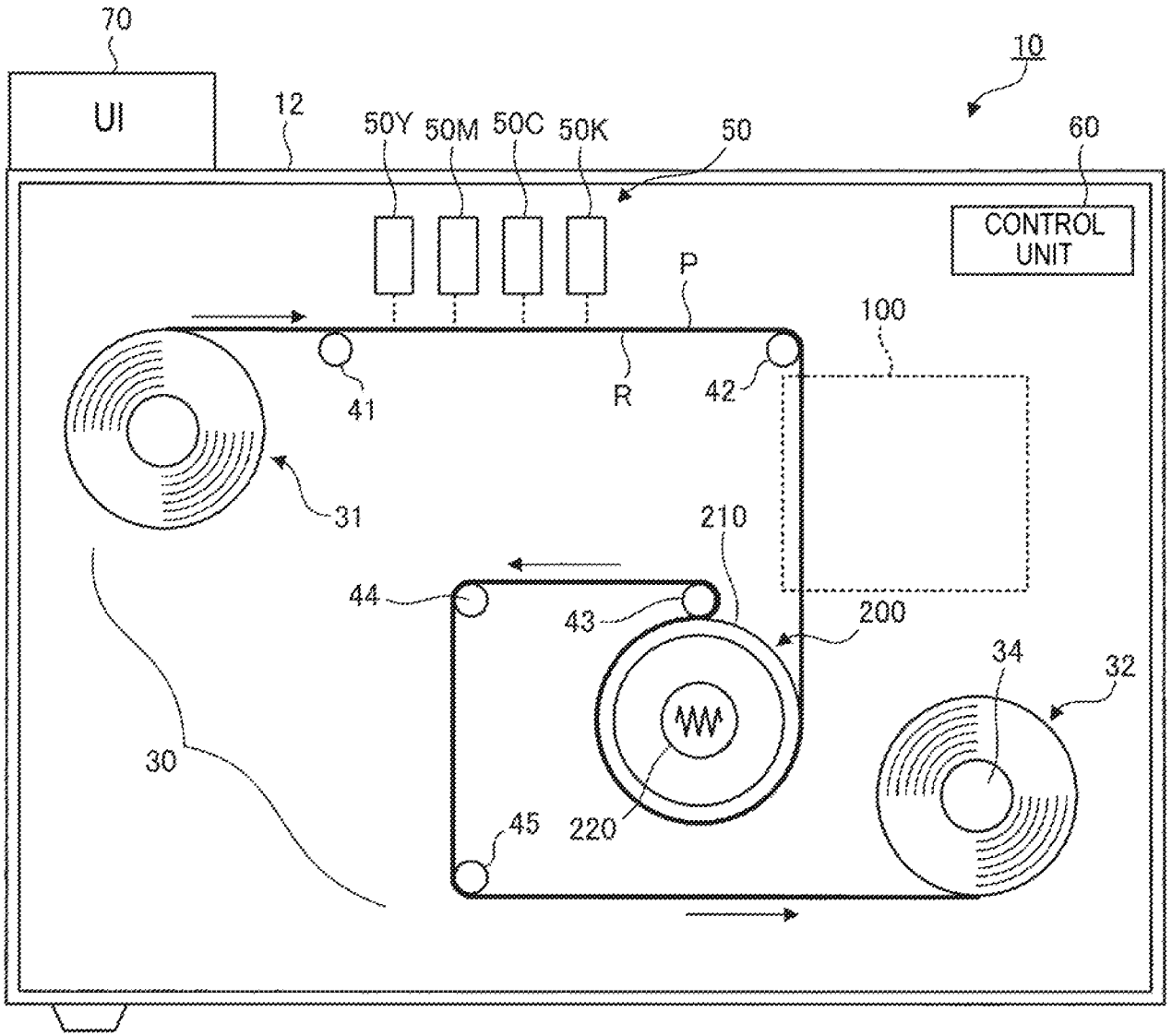
FIG. 1 is a view illustrating an image forming apparatus.

FIG. 1 is a view illustrating an image forming apparatus 10 according to the present exemplary embodiment.

The image forming apparatus 10 has a main body 12 of the image forming apparatus, and in the main body 12 of the image forming apparatus, a conveying mechanism 30 for conveying continuous form paper P which is an example of a recording medium is provided.

The conveying mechanism 30 includes a first holding unit 31 for holding the continuous form paper P to be subjected to image formation in a state where the continuous form paper is wound thereon, and a second holding unit 32 for holding the continuous form paper P subjected to image formation in a state where the continuous form paper is wound thereon.

In the present exemplary embodiment, a rotary shaft 34 provided in the second holding unit 32 is rotated by a motor (not shown in the drawings), whereby winding of the continuous form paper P by the second holding unit 32 is performed. Since this winding is performed, feeding of the continuous form paper P from the first holding unit 31 is performed.

Also, in the present exemplary embodiment, it is possible to change the rotation speed of the rotary shaft 34, and if the rotation speed of the rotary shaft 34 is changed, the moving speed of the continuous form paper P changes. In the present exemplary embodiment, it is possible to change the moving speed of the continuous form paper P.

Further, in the conveying mechanism 30, supporting rollers 41 to 45 for supporting the continuous form paper P are provided beside a movement route R for the continuous form paper P from the first holding unit 31 to the second holding unit 32.

In the present invention, the continuous form paper P is stretched over the supporting rollers 41 to 45 such that parts of the continuous form paper P which are positioned between the supporting rollers 41 to 45 tighten.

Further, in the main body 12 of the image forming apparatus, a droplet ejection part 50 for ejecting colored droplets (ink) onto the continuous form paper P is provided.

In the droplet ejection part 50, ejection heads 50Y, 50M, 50C, and 50K for ejecting ink of yellow, magenta, cyan, and black are provided.

The droplet ejection part 50 ejects the ink of yellow, magenta, cyan, and black onto the continuous form paper P. Therefore, by the droplet ejection part 50, color images are formed on the continuous form paper P.

The ejection heads 50Y, 50M, 50C, and 50K are configured, for example, with inkjet heads, and eject droplets of the ink onto the continuous form paper P.

However, the system for performing image formation using the inkjet heads is not particularly limited, and well-known systems may be used. As examples, piezoelectric systems and thermal systems may be taken.

Also, the ejection heads 50Y, 50M, 50C, and 50K are disposed so as to face a part of the continuous form paper P extending along the horizontal direction, and are disposed above the continuous form paper P.

Further, each of the ejection heads 50Y, 50M, 50C, and 50K is disposed so as to extend along the width direction of the continuous form paper P (a direction intersecting with the movement direction of the continuous form paper P (the direction perpendicular to the plane of the paper of FIG. 1)).

Furthermore, the ejection heads 50Y, 50M, 50C, and 50K are disposed at different positions in the movement direction of the continuous form paper P.

Also, in the movement direction of the continuous form paper P, on the downstream side of the droplet ejection part 50, a first drying device 100 and a second drying device 200 for heating moisture contained in the continuous form paper P to dry the continuous form paper P are provided. Here, in the movement direction of the continuous form paper P, the second drying device 200 is disposed on the downstream side of the first drying device 100.

In the present exemplary embodiment, it is possible to consider the part where the first drying device 100 has been provided, as a first heating part, and it is possible to consider the part where the second drying device 200 has been provided, as a second heating part.

The first drying device 100 heats moisture contained in the droplets (the ink) attached to the continuous form paper P to evaporate the moisture, by irradiating the moving continuous form paper P with light (laser light).

The second drying device 200 heats the moisture contained in the droplets attached to the continuous form paper P to evaporate the moisture, by bringing a hot heating-object member 210 into contact with the moving continuous form paper P.

The heating-object member 210 which is provided in the second drying device 200 is configured with a roller-like member. In the heating-object member 210, a heat source 220 is disposed, and the heating-object member 210 is heated by the heat source 220.

Further, in the present exemplary embodiment, the continuous form paper P is wound on a part of the heating-object member 210, whereby the continuous form paper P is brought into contact with the heating-object member 210. More specifically, in the present exemplary embodiment, the supporting roller 43 is provided so as to be pressed against the heating-object member 210 with the continuous form paper P interposed therebetween, and the supporting roller 43 is used to wind the continuous form paper P on the heating-object member 210.

Further, in the image forming apparatus 10 of the present exemplary embodiment, a control unit 60 and a UI (User Interface) 70 are provided.

The control unit 60 is configured with a CPU, a RAM, a ROM, and so on, and performs control on the individual functional units provided in the image forming apparatus 10.

Also, the UI 70 receives instructions from an operator (a manipulator) who operates the image forming apparatus 10, and notifies information to the operator. The UI 70 is configured with, for example, a touch panel type display.

Figure 2:
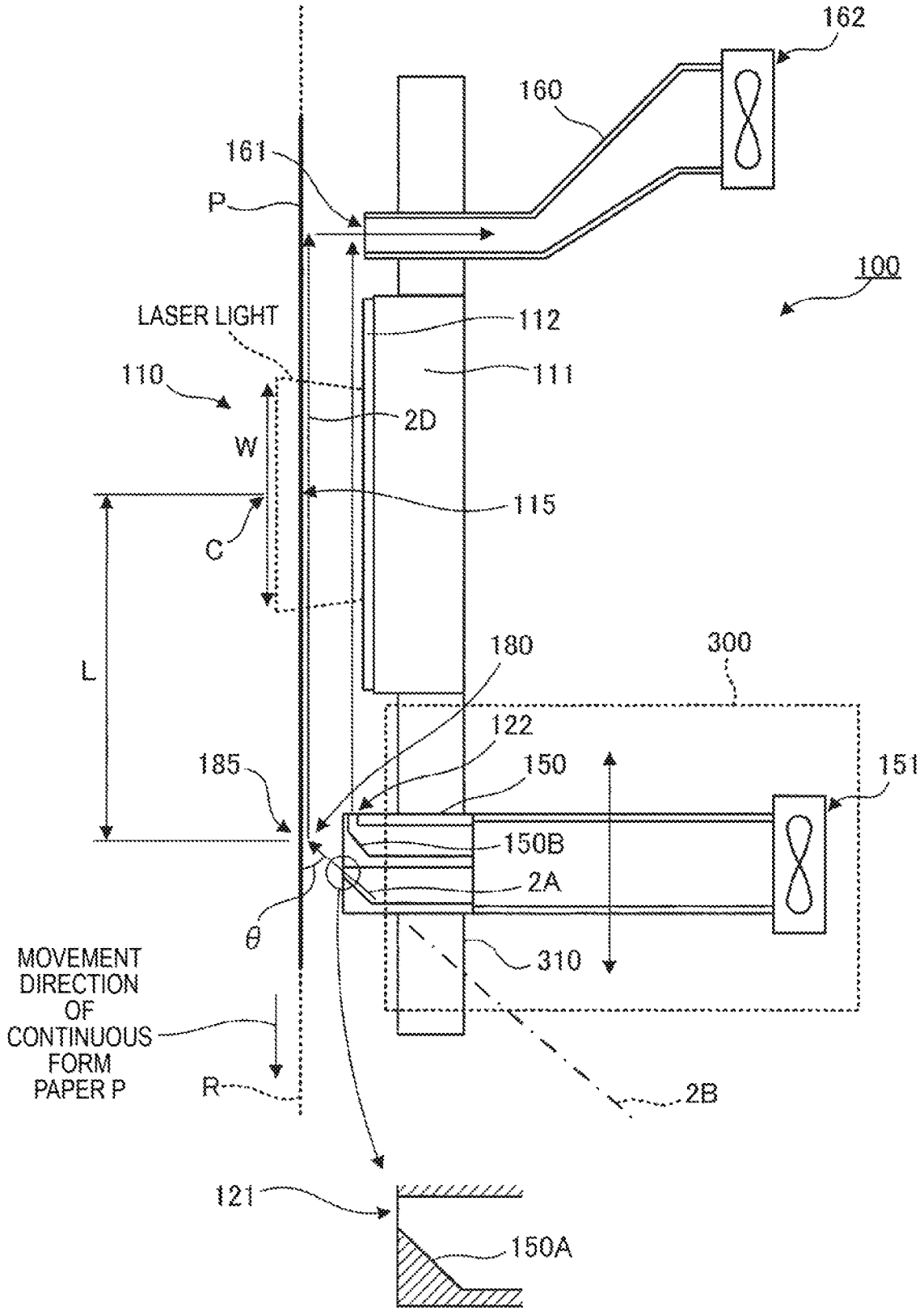
FIG. 2 is a view for explaining a first drying device.

FIG. 2 is a view for explaining the first drying device 100.

In the first drying device 100, a light irradiation part 110 for irradiating the moving continuous form paper P with light (laser light) is provided.

In the present exemplary embodiment, as the light irradiation part 110 irradiates the continuous form paper P with light, the temperature of the moisture contained in the droplets (the ink) attached to the continuous form paper P rises, so evaporation of the moisture accelerates.

In the first drying device 100, a light source 111 for emitting light is provided, and in the present exemplary embodiment, the light irradiation part 110 irradiates the continuous form paper P with light emitted from the light source 111.

Further, in the first drying device 100, between the light source 111 and the movement route R, a transparent plate 112 which transmits light emitted from the light source 111 is provided.

Furthermore, although not shown in the drawings, in the first drying device 100, a drive circuit for driving the light source 111, and a cooling device for cooling the light source 111 are provided.

As the light source 111, for example, laser light sources may be used.

More specifically, for example, VCSEL lasers (Vertical Cavity Surface Emitting Lasers) may be used. VCSEL lasers are vertical cavity surface emitting lasers, and each have light emitting points (for example, thirty-two points) on the light emitting surface.

Also, in the present exemplary embodiment, in the movement direction of the continuous form paper P, on the downstream side from the light irradiation part 110, an air blowing part 180 for blowing air onto the continuous form paper P is provided.

More specifically, in the present exemplary embodiment, in the movement direction of the continuous form paper P, on the downstream side from the light irradiation part 110, a first outlet 121 for discharging air is provided, and air discharged from the first outlet 121 is blown onto the continuous form paper P by the air blowing part 180.

Here, the "air blowing part 180" is positioned at the intersection of the movement route R of the continuous form paper P and the pathway of air which is discharged from the first outlet 121.

As shown by an arrow 2A in FIG. 2, air discharged from the first outlet 121 flows obliquely toward the upper left side, and is blown onto the continuous form paper P.

In other words, in the present exemplary embodiment, air discharged from the first outlet 121 flows toward a position which is on the upstream side in the movement direction of the continuous form paper P and is on the movement route R of the continuous form paper P, and is blown onto the continuous form paper P.

More specifically, in the present exemplary embodiment, air discharged from the first outlet 121 is blown onto the continuous form paper P such that the direction of the flow of the air and the movement route R form an angle θ larger than 0° and smaller than 90°.

Thereafter, the air flows toward the upstream side in the movement direction of the continuous form paper P, along the continuous form paper P, as shown by an arrow 2D.

The first outlet 121 is provided at the downstream side end of an air supply pipe 150 in which air from an air blowing fan 151 flows.

The inner surface of the air supply pipe 150 has an inclined surface 150A, and in the present exemplary embodiment, air is guided by the inclined surface 150A such that air discharged from the first outlet 121 flows toward the position which is on the upstream side in the movement direction of the continuous form paper P and is on the movement route R as described above.

More specifically, the inner surface of the air supply pipe 150 has the inclined surface 150A which gets closer the upstream side in the movement direction of the continuous form paper P as it goes toward the movement route R, and in the present exemplary embodiment, air is guided by the inclined surface 150Am such that air discharged from the first outlet 121 flows toward the position which is on the upstream side in the movement direction of the continuous form paper P and is on the movement route R.

In the case where air is guided by the inclined surface 150A as described above, the air blowing part 180 is positioned roughly at the intersection of the extension line of the inclined surface 150A and the movement route R of the continuous form paper P.

However, for example, the air supply pipe 150 may be disposed along a straight line shown by a reference symbol "2B" in FIG. 2, without forming the inclined surface 150A, so as to form the flow of air to the position which is on the upstream side and is on the movement route R.

In this case, the air blowing part 180 is positioned at the intersection of the straight line shown by the reference symbol "2B" in FIG. 2 and the movement route R of the continuous form paper P.

Also, in the present exemplary embodiment, a second outlet 122 for discharging air is provided.

The second outlet 122 is disposed on the upstream side from the first outlet 121 in the movement direction of the continuous form paper P.

Also, the second outlet 122 is positioned on the downstream side from the light irradiation part 110 in the movement direction of the continuous form paper P, so as to discharge air directed to the light irradiation part 110. More specifically, the second outlet 122 discharges air directed to the space between the transparent plate 112 and the continuous form paper P.

In the present exemplary embodiment, air from the second outlet 122 flows toward the light irradiation part 110. Therefore, the dew condensation in the light irradiation part 110 decreases.

Also, the inner surface of the air supply pipe 150 has an inclined surface 150B, and in the present exemplary embodiment, air is guided by the inclined surface 150B such that air discharged from the second outlet 122 flows toward the light irradiation part 110.

Further, in the present exemplary embodiment, the first outlet 121 and the second outlet 122 are formed in the common air supply pipe 150, not in separate air supply pipes.

The air supply pipe 150 is a so-called air supply duct, and in the present exemplary embodiment, air blown by the air blowing fan 151 flows in the air supply pipe 150 toward the first outlet 121 and the second outlet 122. Then, a part of the air is blown onto the continuous form paper P through the first outlet 121, and flows toward the upstream side along the surface of the continuous form paper P.

Also, the other part of the air flows toward the upstream side in the movement direction of the continuous form paper P, through the second outlet 122, and reaches the light irradiation part 110.

Also, in the present exemplary embodiment, in the movement direction of the continuous form paper P, on the upstream side of the light irradiation part 110, an air exhaust pipe 160 is provided. Further, an end of the air exhaust pipe 160 has an air exhaust opening 161. Specifically, an end of the air exhaust pipe 160 on the movement route (R) side has the air exhaust opening 161. Moreover, an air exhaust fan 162 for discharging air from the air exhaust pipe 160 is provided.

Air discharged from the first outlet 121 and the second outlet 122 and flowing toward the upstream side finally enters the air exhaust pipe 160 through the air exhaust opening 161. Then, the air is finally discharged to the outside of the image forming apparatus 10 (see FIG. 1).

Also, in the present exemplary embodiment, it is possible to change a distance L between a light irradiation position 115 of the light irradiation part 110 on the movement route R and an air-blowing target position 185 of the air blowing part 180 on the movement route R.

In other words, in the present exemplary embodiment, it is possible to change the distance L between the light irradiation position 115 on the movement route R which is the light irradiation position of the light irradiation part 110 and the air-blowing target position 185 on the movement route which is the air-blowing target position of the air blowing part 180.

Here, the "distance L" means the distance L on the movement route R of the continuous form paper P. In other words, the "distance L" means the distance L which is measured along the movement route R of the continuous form paper P.

Also, in the case where the light irradiation position 115 has a width W in the movement direction of the continuous form paper P like the light irradiation position 115 shown in FIG. 2, the distance which is measured from the center point C of the width W is defined as the distance L. Similarly, in the case where the air-blowing target position 185 has a width in the movement direction of the continuous form paper P, the distance which is measured from the center point of the width is defined as the distance L.

In the present exemplary embodiment, a changing mechanism 300 for changing the flow of air directed to the continuous form paper P (air which is blown onto the continuous form paper P) is provided.

Also, in the present exemplary embodiment, if the operator performs an operation on the changing mechanism 300, whereby the changing mechanism 300 is moved, the air-blowing target position 185 changes. Further, in the present exemplary embodiment, if the air-blowing target position 185 changes, the distance L between the light irradiation position 115 and the air-blowing target position 185 changes.

The changing mechanism 300 is configured with the air supply pipe 150 provided so as to be movable along the movement direction of the continuous form paper P, a guiding member 310 for guiding the air supply pipe 150 which moves, and a joining member (not shown in the drawings) for joining the air supply pipe 150 to the guiding member 310.

The guiding member 310 is disposed along the movement route R of the continuous form paper P, and guides the air supply pipe 150 which moves along the movement route R.

In the present exemplary embodiment, if the changing mechanism 300 is moved by the operator, the position of the first outlet 121 changes. More specifically, if the changing mechanism 300 is moved by the operator, the air supply pipe 150 moves, and with this movement, the position of the first outlet 121 changes.

Further, if the position of the first outlet 121 changes, the flow of air becomes different from the flow before the change. Therefore, the air-blowing target position 185 on the continuous form paper P changes.

More specifically, in the present exemplary embodiment, if the changing mechanism 300 is moved by the operator, the first outlet 121 moves along the movement route R of the continuous form paper P, whereby the air-blowing target position 185 in the movement direction of the continuous form paper P changes.

Further, if the air-blowing target position 185 changes, the distance L between the light irradiation position 115 and the air-blowing target position 185 changes.

In the present exemplary embodiment, on the occasion of drying the continuous form paper P having droplets (the ink) attached thereon, air from the first outlet 121 is blown toward the continuous form paper P, whereby the air is supplied onto the continuous form paper P.

In other words, air is blown onto a part of the continuous form paper P positioned at the air blowing part 180.

As a result, moisture vapor staying on the surface of the continuous form paper P moves. Therefore, evaporation of the droplets attached to the continuous form paper P accelerates.

In the case where blowing of air onto the continuous form paper P is not performed, the surface of the continuous form paper P is likely to be covered by moisture vapor caused by evaporation of moisture from droplets (the ink). In this case, it becomes difficult for more moisture to evaporate.

In contrast with this, if air is blown onto the continuous form paper P like in the present exemplary embodiment, the amount of moisture vapor covering the surface of the continuous form paper P decreases, and it becomes easier for more moisture to evaporate.

Figure 3:
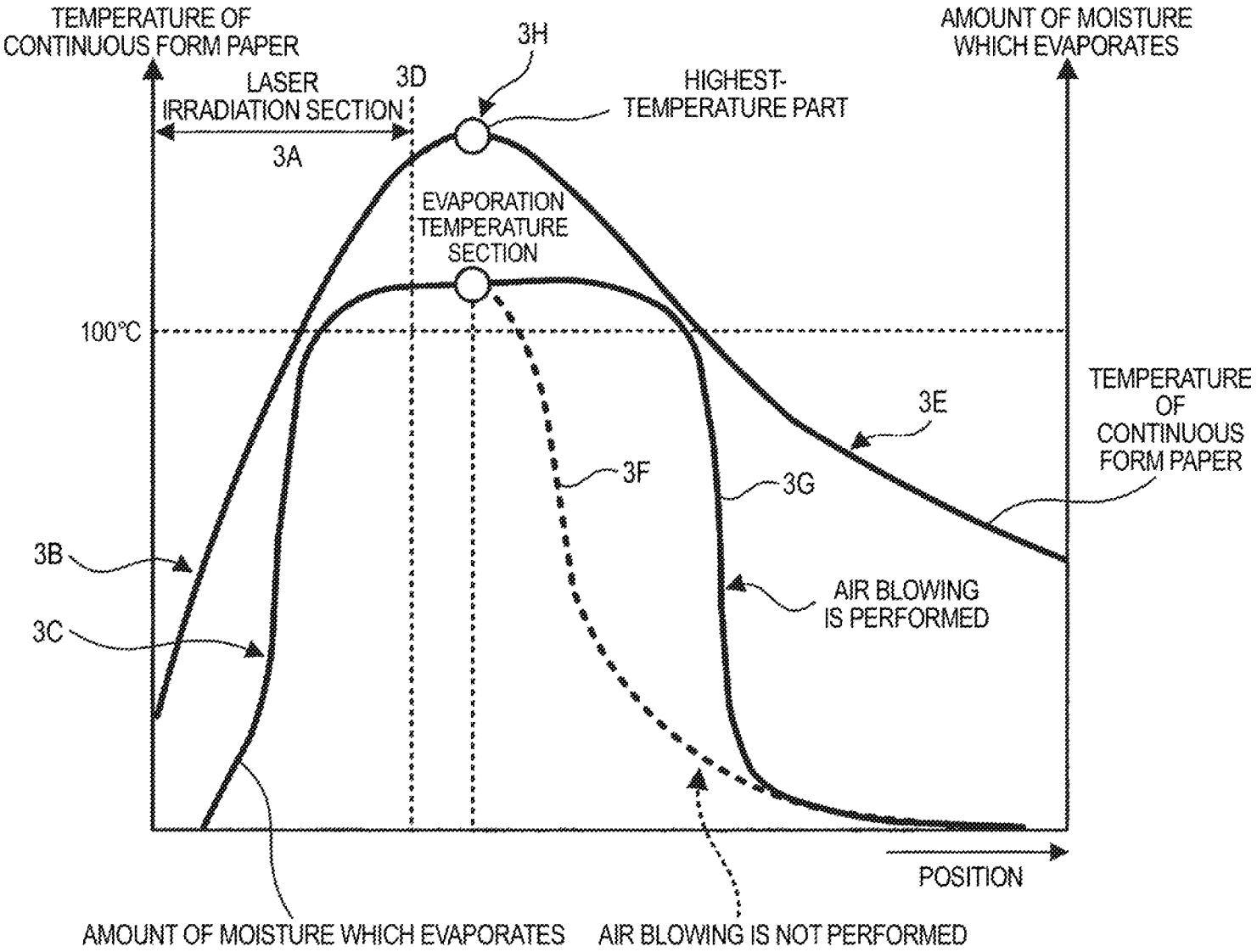
FIG. 3 is a view for explaining the effect of blowing of air onto continuous form paper.

FIG. 3 is a view for explaining the effect of blowing of air onto the continuous form paper P.

In FIG. 3, the horizontal axis represents the position in the movement direction of the continuous form paper P. Also, the vertical axis represents the temperature of the continuous form paper P and the amount of moisture which evaporates.

In FIG. 3, a section 3A represents a section in which light irradiation is performed by the light irradiation part 110. In the section 3A, the temperature of the continuous form paper P rises as shown by a reference symbol "3B", and with the rise in the temperature, the amount of moisture which evaporates increases as shown by a reference symbol "3C". Also, in the latter half of the section 3A, the temperature of the continuous form paper P exceeds 100° C., so more moisture evaporates.

Thereafter, if the continuous form paper P passes through the light irradiation part 110 (in a section on the right side of the position shown by a reference symbol "3D"), the temperature of the continuous form paper P drops as shown by a reference symbol "3E". With this drop, the amount of moisture which evaporates decreases.

Here, a broken line denoted by a reference symbol "3F" in FIG. 3 represents the amount of moisture which evaporates in the case where air blowing is not performed, and in the case where air blowing is not performed, as described above, it becomes difficult for moisture to evaporate, so the amount of moisture which evaporates decreases.

In contrast with this, a line denoted by a reference symbol "3G" represents the amount of moisture which evaporates in the case where blowing of air onto the continuous form paper P at the position denoted by a reference symbol "3I", and in this case, evaporation of moisture accelerates, so the amount of moisture which evaporates increases.

As described above, if blowing of air onto the continuous form paper P is performed, as compared to the case where blowing of air onto the continuous form paper P is not performed, the amount of moisture which evaporates increases, and drying of the continuous form paper P accelerates.

Also, it is desirable that blowing of air onto the continuous form paper P should be performed on a part of the continuous form paper P reaching the highest temperature.

Specifically, in the present exemplary embodiment, the temperature of the continuous form paper P rises as the continuous form paper P is irradiated with light, and on the downstream side from the light irradiation part 110, the temperature of the continuous form paper P reaches the highest temperature.

It is desirable to blow air onto a part of the continuous form paper P having reached the highest temperature (referred to as a highest-temperature part).

More specifically, in the example shown in FIG. 3, the highest-temperature part is positioned in the place denoted by a reference symbol "3H", and in this case, it is desirable that air should be blown onto the highest-temperature part through the first outlet 121 (the air supply pipe 150).

More specifically, the temperature of the continuous form paper P rises later than irradiation of the continuous form paper P with light. Therefore, the highest-temperature part is positioned on the downstream side from the section 3A in which light irradiation is performed. For this reason, it is desirable to blow air onto the highest-temperature part which is positioned on the downstream side from the section 3A in which light irradiation is performed.

In the highest-temperature part, the amount of moisture which evaporates is large, and if air is blown, the amount of moisture which evaporates becomes larger.

By the way, in the present exemplary embodiment, as described above, it is possible to change the moving speed of the continuous form paper P, and if the moving speed of the continuous form paper P is changed, the position of the highest-temperature part changes.

Figure 4:
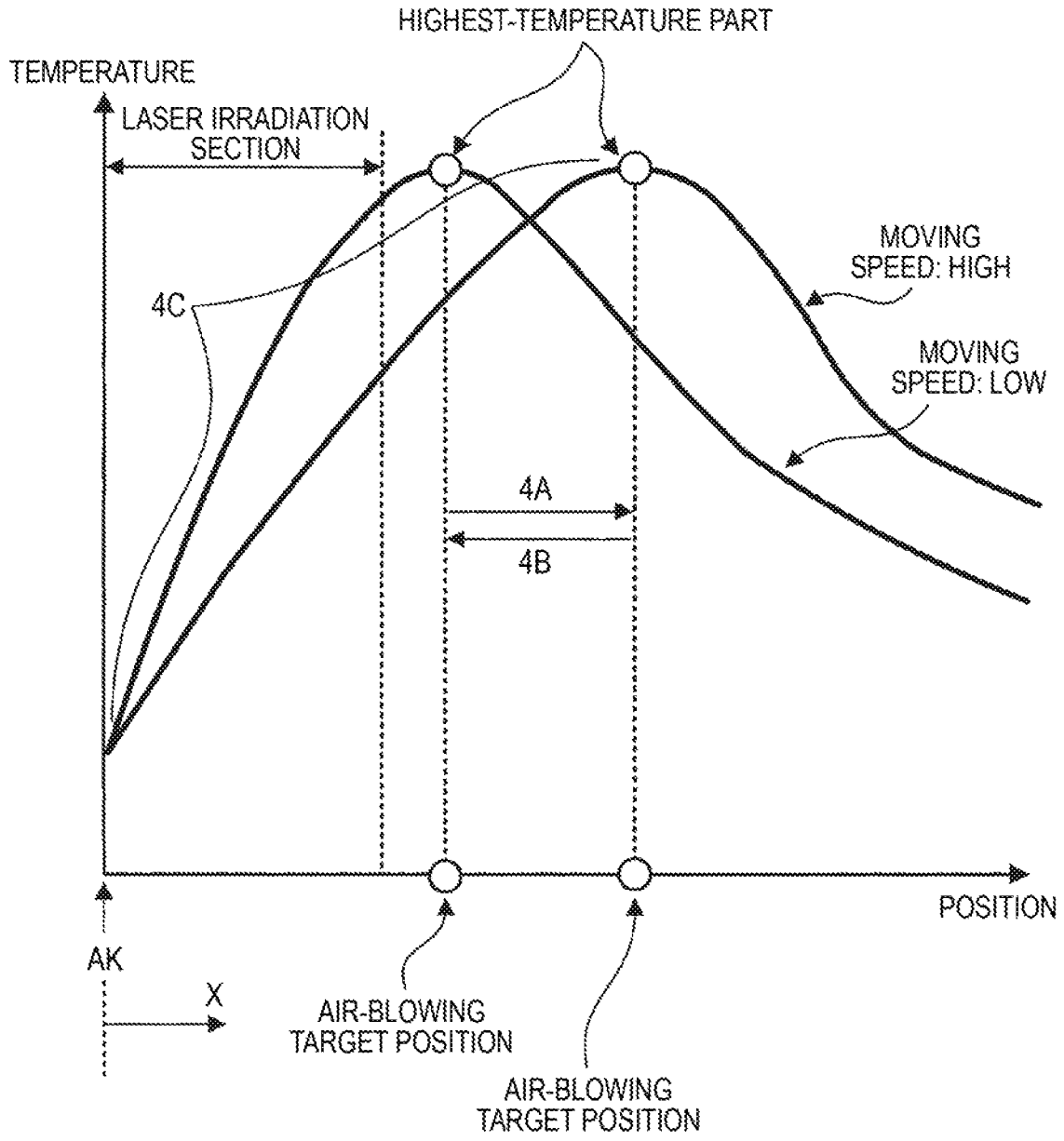
FIG. 4 is a view illustrating the relation between the moving speed of the continuous form paper and the position of a highest-temperature part.

FIG. 4 is view illustrating the relation between the moving speed of the continuous form paper P and the position of the highest-temperature part.

As shown in FIG. 4, in the present exemplary embodiment, depending on the moving speed of the continuous form paper P, the position of the highest-temperature part changes.

Specifically, if the moving speed of the continuous form paper P increases, as shown by an arrow 4A in FIG. 4, the position of the highest-temperature part moves to the downstream side in the movement direction of the continuous form paper P. On the contrary, if the moving speed of the continuous form paper P decreases, as shown by an arrow 4B in FIG. 4, the position of the highest-temperature part moves to the upstream side.

Also, the positions of highest-temperature parts depend on the types of continuous form paper P, and the positions of highest-temperature parts of some types of continuous form paper P move to the downstream side in the movement direction of the continuous form paper P, and the positions of highest-temperature parts of other types of continuous form paper P move to the upstream side in the movement direction of the continuous form paper P.

In such a case, in a configuration in which the air-blowing target position 185 is fixed (it is impossible to change the distance L between the light irradiation position 115 and the air-blowing target position 185), if the position of a highest-temperature part moves as described above, it is difficult to blow air onto the highest-temperature part.

In contrast with this, in the present exemplary embodiment, as described above, the changing mechanism 300 is provided such that it is possible to change the air-blowing target position 185. In other words, it is possible to change the distance L between the light irradiation position 115 and the air-blowing target position 185.

In this case, with reference to the highest-temperature part, the position of the air-blowing target position 185 may be moved. Specifically, the highest-temperature part and the air-blowing target position 185 may be made closer. More specially, the highest-temperature part and the air-blowing target position 185 may be matched.

Therefore, in the present exemplary embodiment, as compared to the configuration in which the air-blowing target position 185 is fixed, evaporation of moisture from the continuous form paper P accelerates.

Figure 5A:
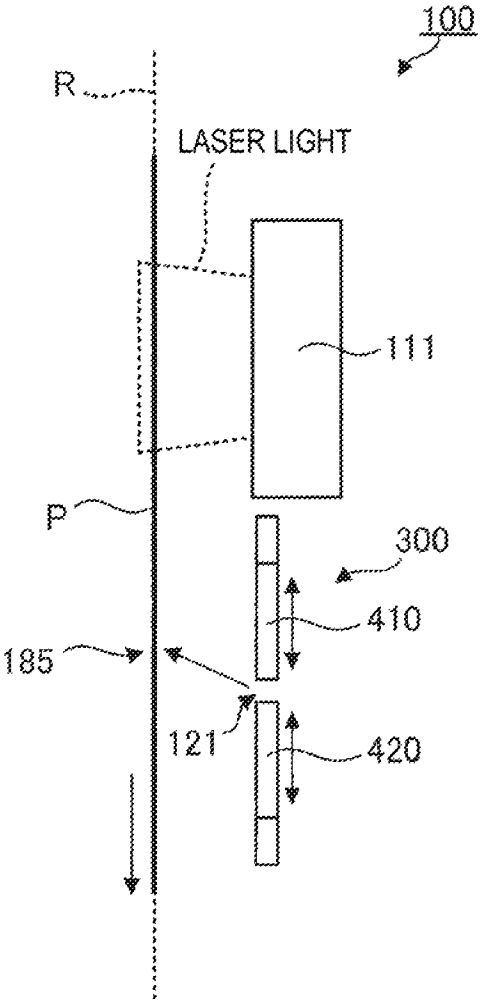
FIGS. 5A, 5B and 5C are views illustrating different configuration examples of a changing mechanism.
Figure 5B:
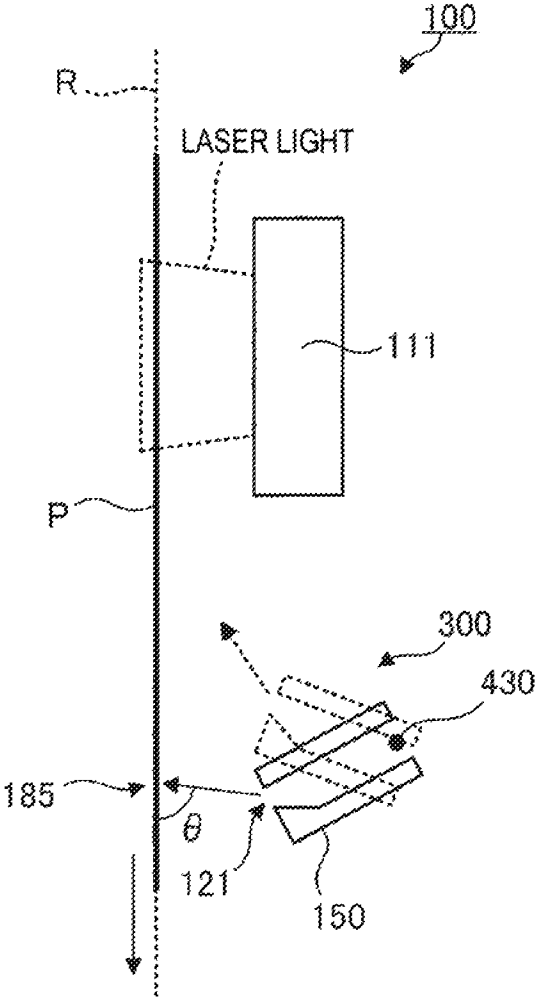
Figure 5C:
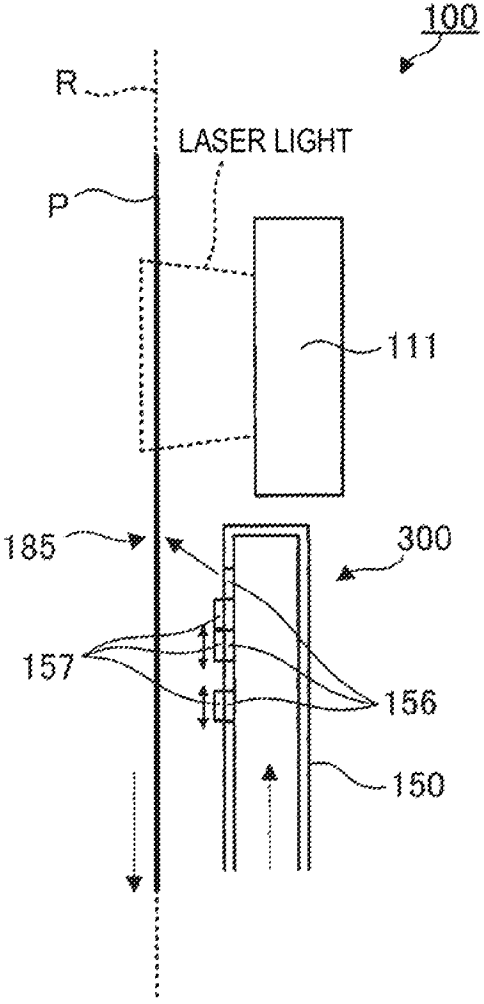

FIGS. 5A, 5B and 5C are views illustrating other configuration examples of the changing mechanism 300.

In the configuration example shown in FIG. 2, the air-blowing target position 185 is changed by moving the air supply pipe 150; however, changing of the air-blowing target position 185 may be performed by other components.

In the configuration example shown in FIG. 5A, between a first shutter member 410 and a second shutter member 420, the first outlet 121 is provided. Each of the first shutter member 410 and the second shutter member 420 is provided so as to be movable in the movement direction of the continuous form paper P.

More specifically, in the configuration example shown in FIG. 5A, between the two movable members (the shutter members) provided so as to be movable, the first outlet 121 is provided, and each of the two movable members may move in the movement direction of the continuous form paper P.

In the changing mechanism 300, to change the air-blowing target position 185, for example, the first shutter member 410 and the second shutter member 420 are moved toward the upstream side in the movement direction of the continuous form paper P. As a result, the air-blowing target position 185 moves to the upstream side. Also, if the first shutter member 410 and the second shutter member 420 are moved toward the downstream side, the air-blowing target position 185 moves to the downstream side.

Also, although not described above, the changing mechanism 300 may be operated to move by the operator, or may be moved by a drive mechanism such as a motor and so on.

FIG. 5B is a view illustrating another configuration example in which changing of the air-blowing target position 185 is performed by changing the orientation of the first outlet 121.

In this configuration example, the air supply pipe 150 is configured to be rotatable on a rotary shaft 430, and if the air supply pipe 150 is rotated on the rotary shaft 430, the orientation of the first outlet 121 changes.

More specifically, the air supply pipe 150 is configured to be rotatable on the rotary shaft 430 extending along the width direction of the continuous form paper P (the direction perpendicular to the extension direction of the continuous form paper P), and if the air supply pipe 150 is rotated on the rotary shaft 430, the orientation of the first outlet 121 changes.

As a result, the air blowing direction changes, and the air-blowing target position 185 in the movement direction of the continuous form paper P changes.

Further, in this configuration example, if the air supply pipe 150 is rotated, the air blowing angle relative to the continuous form paper P changes. More specifically, the angle θ between the traveling direction of air discharged from the first outlet 121 and the movement route R changes.

FIG. 5C is a further configuration example in which changing of the air-blowing target position 185 is performed by performing opening or closing (moving) of shutter members.

In this configuration example, an air supply pipe 150 is provided so as to extend along the movement direction of the continuous form paper P. Also, in a part of the air supply pipe 150 facing the movement route R, outlets 156 are formed, and shutter members 157 (blocking members) for blocking the outlets 156 are provided.

In this configuration example, in order to change the air-blowing target position 185, opening or closing of the shutter members 157 are performed.

Specifically, in this configuration example, any one of the shutter members 157 is opened such that air is blown onto the continuous form paper P through the outlet 156 with the open shutter member 157.

Further, in order to change the air-blowing target position 185, the open outlet 156 is closed by moving the shutter member 157, and another shutter member 157 is moved to open another outlet 156. In this way, switching between the outlets 156 is performed. As a result, the air-blowing target position 185 changes.

Until now, the case of changing the position or orientation of the first outlet 121 has been described. However, the size of the first outlet 121 may be changed to change the blowing target position.

Specifically, the size of the first outlet 121 in the movement direction of the continuous form paper P may be changed to change the blowing target position.

More specifically, for example, shutter members (movable members) are provided so as to be movable in the movement direction of the continuous form paper P, like the first shutter member 410 and the second shutter member 420 shown in FIG. 5A.

In this configuration, if the size of the first outlet 121 is changed by moving one or both of the shutter members in the movement direction of the continuous form paper P, the blowing target position changes.

Also, as another alternative, both of the position and orientation of the first outlet 121 may be changed to change the blowing target position.

Specifically, in FIG. 5B, the rotatable air supply pipe 150 is shown; however, for example, an air supply pipe 150 may be provided such that the air supply pipe 150 may rotate and move along the movement route R of the continuous form paper P.

Also, changing of the distance L may be performed by changing the light path of light for irradiating the continuous form paper P.

Figure 6:
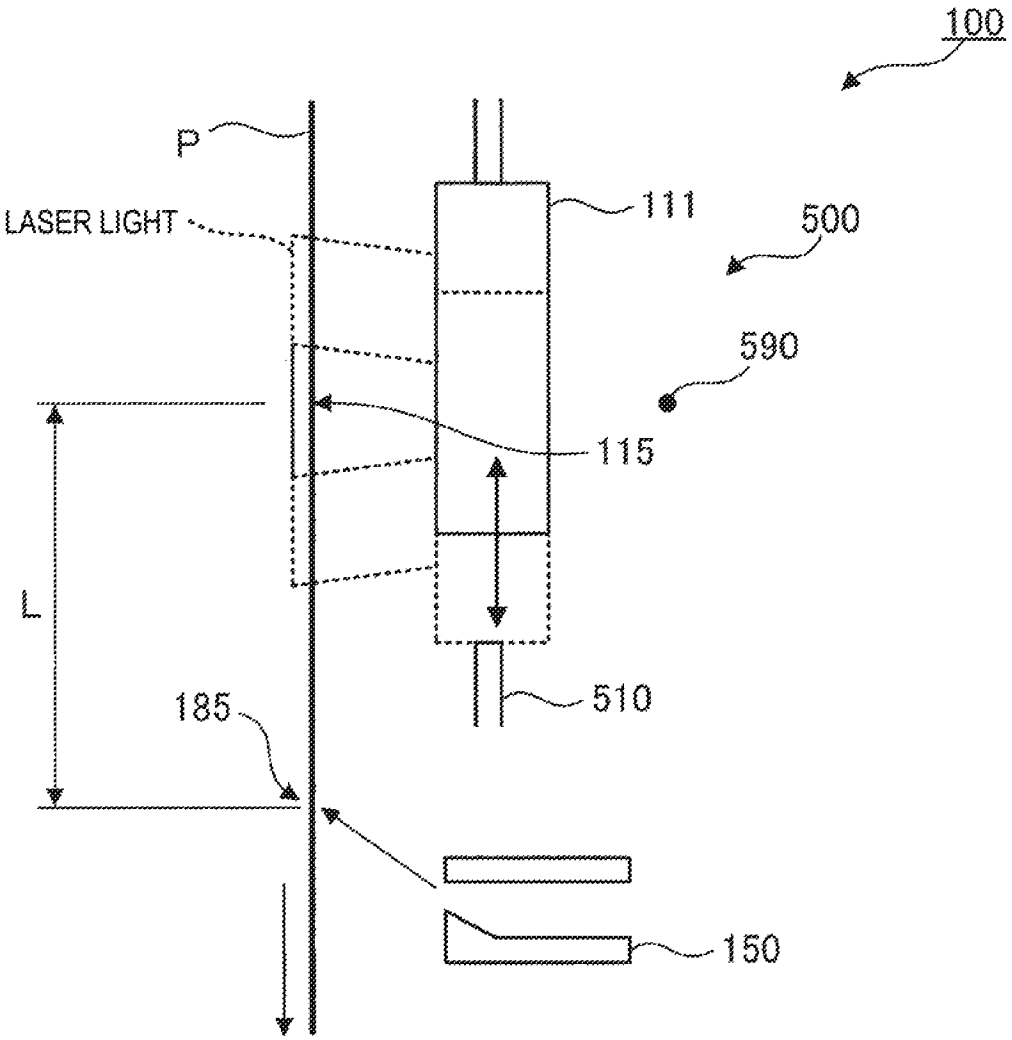
FIG. 6 is a view illustrating a specific example in which distance change is performed by changing a light path.

FIG. 6 is a view illustrating a specific example in which the light path is changed to change the distance L.

In the configuration example shown in FIG. 6, a changing mechanism 500 for changing the light path of light for irradiating the continuous form paper P is provided. In this changing mechanism 500, a light source 111 is configured to be able to move along the movement direction of the continuous form paper P. Further, in the changing mechanism 500, a guiding member 510 is provided along the movement direction of the continuous form paper P so as to guide the movable light source 111.

In this configuration example, to change the light path of light for irradiating the continuous form paper P, the changing mechanism 500 is driven by a drive mechanism.

Accordingly, the light source 111 moves toward the downstream side or the upstream side in the movement direction of the continuous form paper P. As a result, the light path of light for irradiating the continuous form paper P changes, and the light irradiation position 115 changes. Further, if the light irradiation position 115 changes, the distance L between the light irradiation position 115 and the air-blowing target position 185 changes.

Alternatively, changing of the light path may be performed by changing the posture of the light source 111.

Specifically, for example, the light source 111 may be rotated on a rotary shaft (a rotary shaft extending along the width direction of the continuous form paper P) shown by a reference symbol "590", to change the light path.

Also, as another alternative, both of the position of the light source 111 (the position in the movement direction of the continuous form paper P) and the posture of the light source 111 may be changeable to change the light path.

Also, as another alternative, changing of the light path (changing of the light irradiation position 115) may be performed by moving reflective members (not shown in the drawings) for reflecting light emitted from the light source 111, such as mirrors and so on.

Also, in each of FIG. 2 to FIG. 6, the case of performing any one of changing of the air-blowing target position 185 and changing of the light irradiation position 115 has been described; however, both of changing of the air-blowing target position 185 and changing of the light irradiation position 115 may be capable of being performed.

Figure 7:
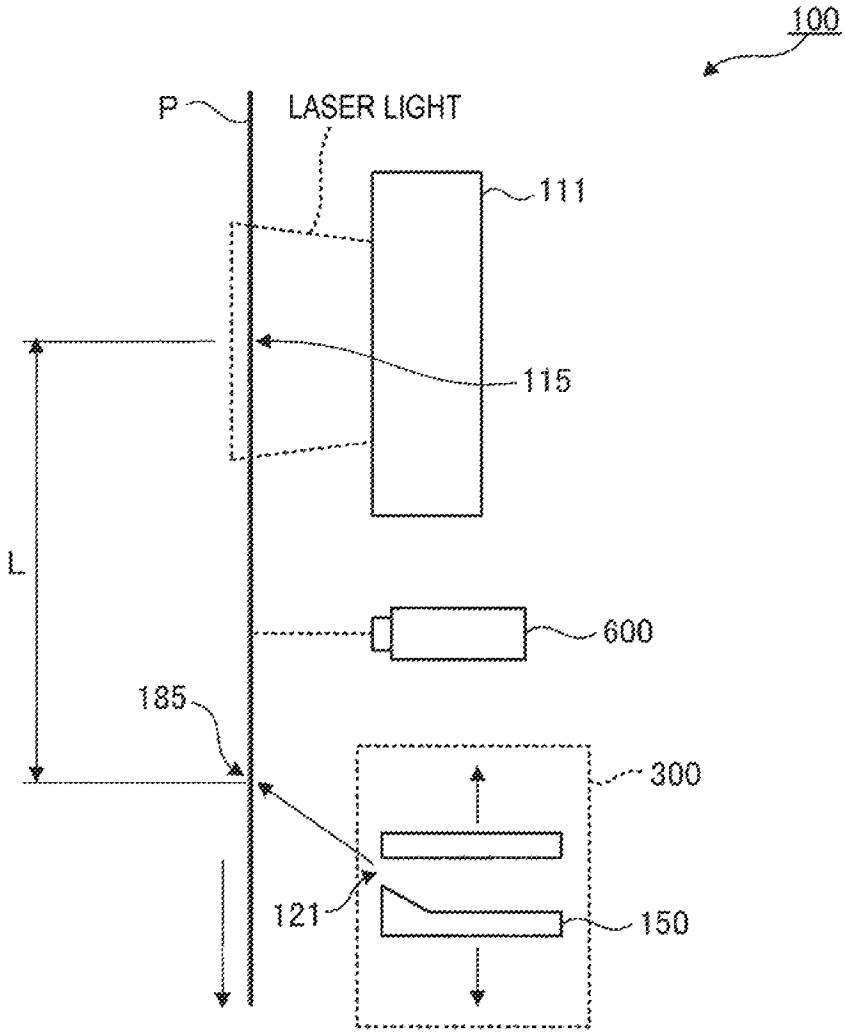
FIG. 7 is a view illustrating another configuration example of the first drying device.

Also, as shown in FIG. 7 (a view illustrating another configuration example of the first drying device 100), a temperature sensor 600 may be installed as an example of a detection unit for detecting the temperature of the continuous form paper P.

In this configuration example, at a position which is on the downstream side from the light irradiation position 115 and is on the upstream side from the air-blowing target position 185, the temperature sensor 600 detects the temperature of a part of the continuous form paper P.

In other words, the temperature sensor 600 detects the temperature of a part of the continuous form paper P positioned on the downstream side from the light irradiation position 115 and on the upstream side from the air-blowing target position 185.

Further, in this configuration example, the above-mentioned changing mechanism 300 (the changing mechanism 300 for changing the flow of air directed to the continuous form paper P) is provided.

In this configuration example, the control unit 60 (see FIG. 1) which is an example of a changing unit determines a distance L on the basis of the detection result of the temperature sensor 600.

Then, the control unit 60 moves the changing mechanism 300, thereby changing the air-blowing target position 185 such that the distance L between the light irradiation position 115 and the air-blowing target position 185 becomes the determined distance L.

In other words, the control unit 60 moves the changing mechanism 300, for example, to move the first outlet 121 to change the distance L between the light irradiation position 115 and the air-blowing target position 185.

In the present exemplary embodiment, if the temperature of the continuous form paper P may be seen, the approximate position of the highest-temperature part may be seen.

More specifically, in the present exemplary embodiment, as shown by a reference symbol "4C" in FIG. 4, the movement distance X of the continuous form paper P from a start point which is a predetermined reference position AK (for example, the inlet of the light irradiation part 110), and the temperature of the continuous form paper P are substantially proportional to each other. Therefore, if the temperature of a part of the continuous form paper P may be seen, the approximate position of the highest-temperature part may be seen.

For this reason, in the configuration example shown in FIG. 7, the control unit 60 grasps the temperature of a part of the continuous form paper P, on the basis of the detection result of the temperature sensor 600, and grasps (estimates) the position of the highest-temperature part, on the basis of the grasped temperature.

Then, the control unit 60 changes the position of the first outlet 121 (to change the distance L between the light irradiation position 115 and the air-blowing target position 185), such that air is blown onto the grasped (estimated) position of the highest-temperature part.

Alternatively, two or more temperature sensors 600 may be provided. Specifically, two or more temperature sensors 600 may be provided at different positions in the movement direction of the continuous form paper P.

In this case, as compared to the case where one temperature sensor 600 is provided, it becomes possible to more accurately perform grasping of the slope of rising of the temperature of the continuous form paper P, so it is possible to more accurately perform specifying of the position of the highest-temperature part.

Alternatively, the temperature sensor 600 may be provided so as to be movable in the width direction of the continuous form paper P. Some images which are formed on the continuous form paper P may have such shapes that the images are deviated from the position facing the temperature sensor 600. In the case where it is possible to move the temperature sensor 600, it is possible to dispose the temperature sensor 600 at a position facing each image.

Also, regardless of the detection result of the temperature sensor 600, the position of the first outlet 121 may be determined (the distance L between the light irradiation position 115 and the air-blowing target position 185 may be determined).

Specifically, for example, the position of the first outlet 121 may be determined on the basis of information such as the type of the continuous form paper P, the moving speed of the continuous form paper P, the output of the light source 111, and so on.

More specifically, for example, a table defining the relation between various conditions such as the type of the continuous form paper P, the moving speed of the continuous form paper P, the output of the light source 111, and so on, and highest-temperature part positions is stored in a memory (not shown in the drawings) in advance. In this case, on the occasion of determining the position of the first outlet 121, actual conditions in which image formation is performed on the continuous form paper P may be acquired, and with reference to the table, the position of the first outlet 121 may be determined.

More specifically, since the position of the highest-temperature part is determined according to various conditions such as the type of the continuous form paper P, the moving speed of the continuous form paper P, the output of the light source ill, and so on, on the basis of these conditions, the position of the first outlet 121 may be determined.

Herein, the cases of determining the position of the first outlet 121 on the basis of the detection result of the temperature sensor 600 or various conditions have been described as examples. However, besides the position of the first outlet 121, the orientation or size of the first outlet 121 or the position or posture of the light source 111 may be changed on the basis of the detection result of the temperature sensor 600 or various conditions.

Also, as another alternative, the detection result of the temperature sensor 600 may be just output. For example, the detection result may be displayed on the UI 70 or may be transmitted to an external device.

Changing of the position of the first outlet 121 or the like (changing of the distance L) may be manually performed by the operator, and the detection result of the temperature sensor 600 may be notified to the operator by performing a process of outputting the detection result.

(Others)

Until now, the case of using the continuous form paper P as a recording medium has been described. However, as recording media, besides the continuous form paper P, sheets of paper such as cut sheets and so on may be used. In other words, the above-described configurations may also be applied to image forming processes and dying processes which are performed on recording media other than continuous form paper P, such as cut sheets and so on.

Also, although the case of forming color images on the continuous form paper P has been described above, images which are formed on the continuous form paper P are not limited to color images, and may be monochrome images.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drying device comprising:

a light irradiation part that irradiates a recording medium on a recording-medium movement route with light to evaporate moisture contained in droplets attached to the recording medium; and an air blowing part that is positioned on a downstream side from the light irradiation part in a recording-medium movement direction, and blows air onto the recording medium on the recording-medium movement route, wherein the drying device changes the distance between a light irradiation position of the light irradiation part on the recording-medium movement route and an air-blowing target position of the air blowing part on the recording-medium movement route, the drying device being configured to:

change a light irradiation position of the light irradiation part in the recording-medium movement direction; and change an air-blowing target position of the air blowing part in the recording-medium movement direction, to change a distance between the light irradiation position and the air-blowing target position.

2. The drying device according to claim 1, wherein:

as the light irradiation part irradiates the recording medium with light, a temperature of the recording medium rises, and on the downstream side from the light irradiation part, the temperature of the recording medium reaches the highest temperature, and when the distance is changed, the air-blowing target position with respect to the position where the temperature of the recording medium reaches the highest temperature is changed.

3. The drying device according to claim 2, wherein:

by performing changing of the distance, the drying device makes the position where the temperature of the recording medium reaches the highest temperature and the air-blowing target position closer.

4. The drying device according to claim 3, wherein:

by performing changing of the distance, the drying device matches the position where the temperature of the recording medium reaches the highest temperature and the air-blowing target position.

5. The drying device according to claim 1, further comprising a changing mechanism that changes a flow of air directed to the recording medium, wherein when the changing mechanism is moved, the air-blowing target position is changed, and the distance is changed.

6. The drying device according to claim 5, further comprising an outlet that discharges the air directed to the recording medium, wherein when the changing mechanism is moved, at least one of an orientation and a position of the outlet are changed, and the air-blowing target position is changed.

7. The drying device according to claim 6, wherein:

when the changing mechanism is moved, the outlet moves along the recording-medium movement direction, and the air-blowing target position is changed.

8. The drying device according to claim 1, further comprising a changing mechanism that changes a light path of the light for irradiating the recording medium, wherein when the changing mechanism is moved, the light irradiation position is changed, and the distance is changed.

9. The drying device according to claim 8, wherein the light irradiation part comprises a light source that emits the light for irradiating the recording medium, and when the changing mechanism is moved, at least one of a position and a posture of the light source are changed, and the light irradiation position is changed.

10. The drying device according to claim 9, wherein:

when the changing mechanism is moved, the light source moves along the recording-medium movement direction, and the light irradiation position is changed.

11. The drying device according to claim 1, further comprising a detection part that detects the temperature of the recording medium, at a position which is on the downstream side from the light irradiation position and is on the upstream side from the air-blowing target position.

12. The drying device according to claim 11, further comprising a changing part that changes a distance between the light irradiation position and the air-blowing target position, based on a detection result of the detection part.

13. The drying device according to claim 1, further comprising:

a first outlet that is formed in an air supply pipe and discharges the air which is blown onto the recording medium; and a second outlet that is formed in a part of an air supply pipe which is positioned on the downstream side from the light irradiation part in the recording-medium movement direction, and discharges the air directed to the light irradiation part, wherein the first outlet and the second outlet are formed in a common air supply pipe.

14. An image forming apparatus comprising:

an ejection part that ejects droplets onto a recording medium; and a drying device that dries the recording medium subjected to the droplet ejection of the ejection part, wherein the drying device is configured with the drying device according to claim 1.

15. A drying device comprising:

a light irradiation part that irradiates a recording medium which moves with light to evaporate moisture contained in droplets attached to the recording medium; and an outlet that is positioned on a downstream side from the light irradiation part in a recording-medium movement direction, and discharges air which is blown onto the recording medium, wherein one or more of the orientation, size, and position of the outlet is changed, and/or at least one of the position and posture of a light source that emits the light for irradiating the recording medium is changed, the drying device being configured to:

change a position of the light irradiation part in the recording-medium movement direction; and change a position of the outlet in the recording-medium movement direction, to change a distance between the light irradiation part and the outlet.

16. An image forming apparatus comprising:

an ejection part that ejects droplets onto a recording medium; and a drying device that dries the recording medium subjected to the droplet ejection of the ejection part, wherein the drying device is configured with the drying device according to claim 15.

* * * * *